United States Patent [19]

Staats

[11] Patent Number: 4,523,069

[45] Date of Patent: Jun. 11, 1985

[54] MICROWAVE OVEN DOOR SEAL

[75] Inventor: James E. Staats, Louisville, Ky.

[73] Assignee: General Electric Company, Louisville, Ky.

[21] Appl. No.: 544,799

[22] Filed: Oct. 24, 1983

[51] Int. Cl.[3] ..... H05B 6/76

[52] U.S. Cl. ..... 219/10.55 D; 174/35 GC

[58] Field of Search ..... 219/10.55 D, 10.55 R; 174/35 GC, 35 R, 35 MS; 333/12, 227, 228, 254, 256

[56] References Cited

U.S. PATENT DOCUMENTS

| | | | |
|---|---|---|---|
| 2,772,402 | 11/1956 | Tomiyasu . | |
| 3,210,512 | 10/1965 | Eason | 219/10.55 D |
| 3,584,177 | 6/1971 | Bucksbaum | 219/10.55 D |
| 3,651,300 | 3/1972 | Haagensen | 219/10.55 D |
| 3,767,884 | 10/1973 | Osepchuk et al. | 219/10.55 D |
| 3,812,316 | 5/1974 | Milburn | 213/10.55 D |
| 3,835,283 | 9/1974 | Suzuki | 219/10.55 D |
| 4,122,323 | 10/1978 | Staats | 219/10.55 D |
| 4,247,838 | 1/1981 | Sirel | 333/254 |
| 4,254,318 | 3/1981 | Ohkawa et al. | 219/10.55 D |
| 4,313,044 | 1/1982 | Staats | 219/10.55 D |
| 4,449,025 | 5/1984 | Ikeda et al. | 219/10.55 D |

*Primary Examiner*—Philip H. Leung

*Attorney, Agent, or Firm*—H. Neil Houser; Radford M. Reams

[57] ABSTRACT

A microwave oven door seal arrangement for inhibiting microwave energy leakage employs an energy splitting and phase shifting device disposed proximate the door gap formed between the access opening to the oven cavity and the oven door. The energy splitting and phase shifting device initially splits the energy attempting to escape through the door gap between two intersecting transmission paths. An inner intersection is provided near the inner edge of the gap relatively near the cavity, at which point the energy splits between the two paths. An outer intersection is provided near the outer edge of the door gap relatively remote from the cavity, at which point the energy propagating along the two paths recombines. The paths differ in effective electrical length between these intersections by an odd integral multiple of one-half the wavelength of the energy resulting in a half wavelength phase difference at the point of recombination between the energy from one path and that from the other. Consequently, upon recombination at the outer intersection, the energy from one path substantially cancels the energy from the other, effectively inhibiting energy leakage beyond the region of the door gap.

21 Claims, 13 Drawing Figures

FIG. 1
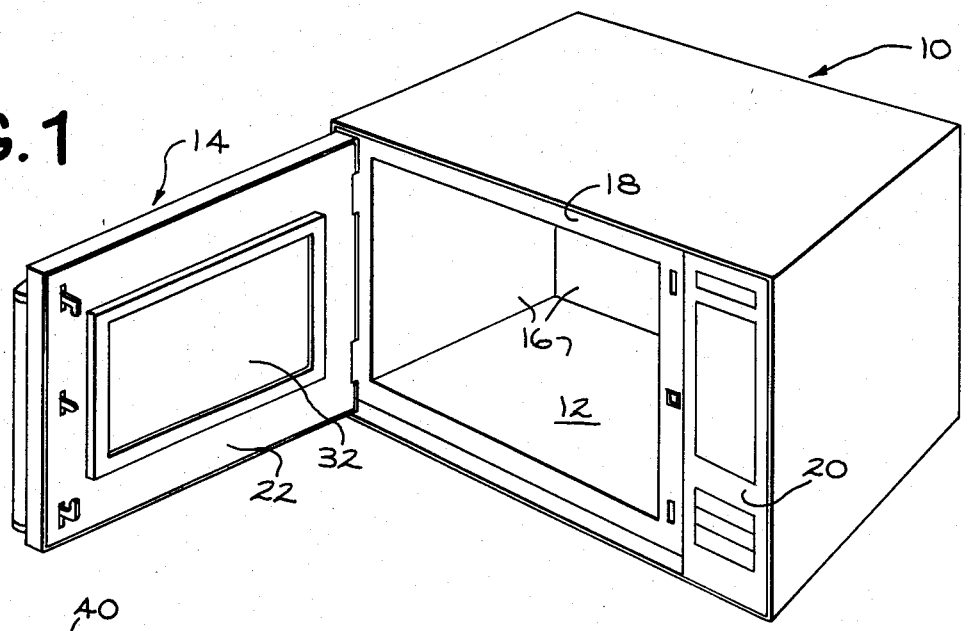
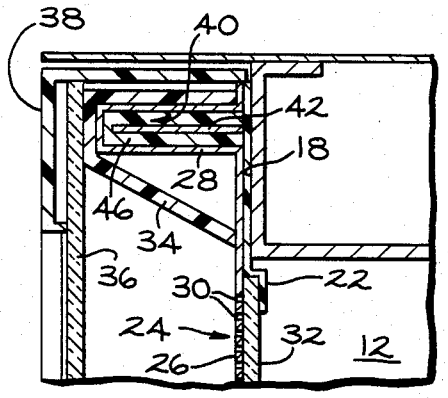
FIG. 2
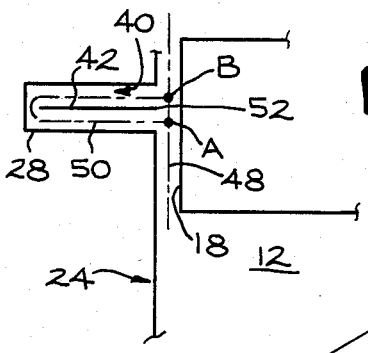
FIG. 2A
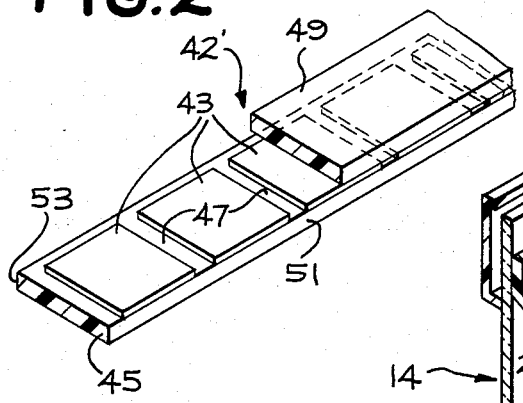
FIG. 4
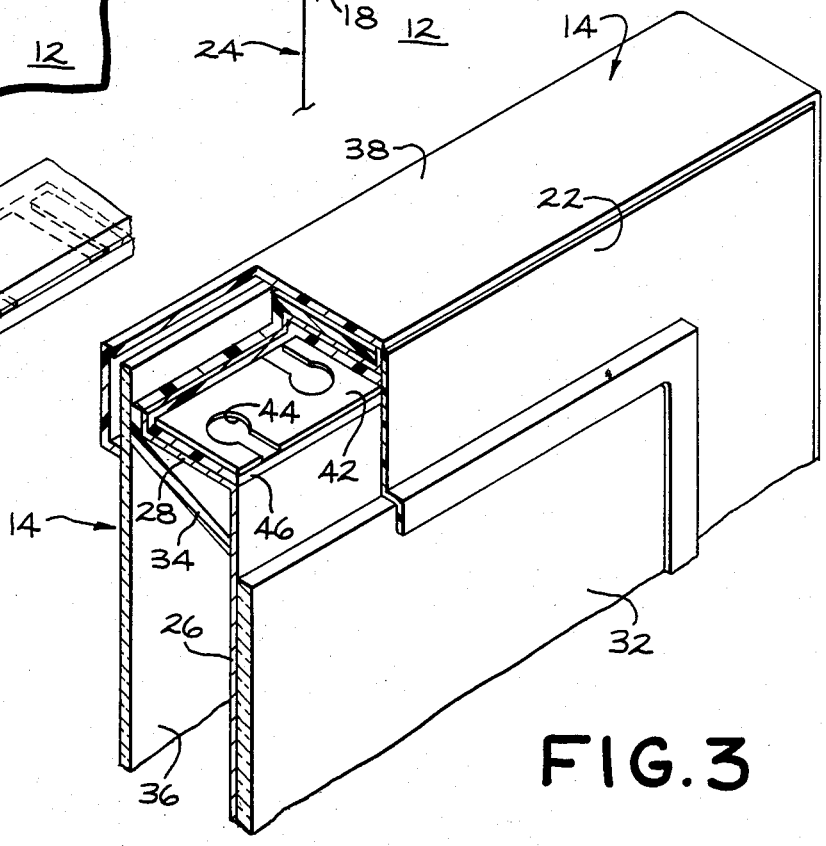
FIG. 3

MICROWAVE OVEN DOOR SEAL

BACKGROUND OF THE INVENTION

This invention is directed to an improved microwave energy seal for a microwave oven.

One major objective in designing domestic microwave ovens is to maintain the leakage of microwave energy from the oven cavity during oven operation below the maximum allowable levels established by state and federal regulating agencies. Ovens presently commercially available employ energy seal structures which adequately meet these requirements; however, there is a continuing interest on the part of manufacturers in improving the seal arrangements to substantially exceed government standards.

Various approaches to the energy sealing problem which have been employed commercially include direct electrical contact between the door and the cavity walls, such as by means of a metal mesh gasket as disclosed in U.S. Pat. No. 3,812,316 to Milburn; a capacitive type door seal in which a flat surface around the periphery of the cavity access opening and a corresponding flat surface about the periphery of the inner door panel form the two plates of a capacitor which presents nearly a short circuit to microwave energy attempting to escape through the door gap; and various choke structures having choke cavities which at least partially circumscribe the door gap with an effective electrical length of either one-quarter or one-half wavelength based upon a quarter wavelength transmission line impedance transformer principle to effectively present either a high impedance to block passage of microwave energy or to a low impedance to shunt the microwave energy depending upon the particular application.

The aforementioned seal devices may appear separately or may be combined in various ways, with one device serving as back-up for the other. For example, a choke may be used in combination with a metal-to-metal contact type seal. Lossy gasket materials such as conductive rubber or ferrite impregnated rubber are commonly employed in combination with choke-type door seals.

An example of a relatively compact choke type device which may be used separately or in combination with a metal mesh gasket, which device is particularly applicable to pyrolytic self-cleaning oven cavities, is described in commonly-assigned U.S. Pat. No. 4,122,323 to the present inventor.

Examples of other energy seal arrangements known in the microwave oven art are described in U.S. Pat. No. 3,651,300 to Haagensen; U.S. Pat. No. 4,254,318 to Ohkawa et al and U.S. Pat. No. 4,313,044 to the present inventor.

Haagensen teaches the use of a serpentine "antenna" which generally encircles the oven door opening to provide a lossy transmission line which dissipates energy propagating along the line, as a secondary means for attenuating energy leaking from the cavity. The primary sealing arrangement comprises a spring seal metal-to-metal contact type structure. The antenna serves both to attenuate energy escaping through the spring seal and as a sensor to detect leakage levels in excess of a predetermined threshold level.

The Ohkawa et al patent discloses a microwave oven door seal arrangement in which a plurality of reactance elements are distributed about the periphery of the opening to the cooking cavity to form a series resonance circuit connected in parallel with the parallel plate transmission line formed by the door and cavity. The series resonance circuit provides a high frequency short circuit plane at the location of the reactance elements which reflects energy tending to leak through the peripheral area of the door back toward the cooking cavity. In one embodiment the reactance elements are provided by a corrugated metal sheet disposed about the periphery of the cavity access opening.

Staats' '044 patent discloses a choke seal arrangement in which a conductive plate overlies a portion of a recessed channel mounted to the inner face of the door and which forms a closed loop juxtaposed to the cavity wall defining the access opening to the cooking cavity. The plate and channel cooperate with the cavity wall to form a choke type seal. Slots are provided in the plate to inhibit longitudinal currents in the choke. The width of the slots is varied as a function of depth to improve the effectiveness of the seal in preventing longitudinal currents.

While the seal arrangements known in the art work satisfactorily, relatively stringent manufacturing tolerances in mounting the door to the oven are essential in each instance to control the gap therebetween. Consequently, a need exists for a door seal arrangement which maintains energy leakage at levels well within permissible levels but which does not require the tight manufacturing tolerances on the door assembly required by seal arrangments presently in use.

It is therefore an object of the present invention to provide an energy sealing arrangement for a microwave oven which consistently limits leakage around the door to a level well within prescribed regulatory limits without need for close door gap tolerances.

SUMMARY OF THE INVENTION

Briefly stated, in accordance with the present invention, a door seal arrangement for a microwave oven for inhibiting microwave energy leakage is provided which employs an energy splitting and phase shifting device disposed proximate the door gap formed between the access opening to the oven cavity and the oven door. The energy splitting and phase shifting device initially splits the energy attempting to escape through the door gap between two intersecting transmission paths. A first or inner intersection is provided near the inner edge of the gap relatively near the cavity, at which point the energy splits between the two paths. A second or outer intersection is provided near the outer edge of the door gap relatively remote from the cavity, at which point the energy propagating along the two paths recombines. The paths differ in effective electrical length between these intersection points by an odd integral multiple of one-half the wavelength of the energy resulting in a half wavelength phase difference at the point of recombination between the energy from one path and that from the other. Consequently, upon recombination at the outer intersection, the energy from one path substantially cancels the energy from the other, effectively inhibiting energy leakage beyond the region of the door gap.

In accordance with one aspect of the invention, the door seal arrangement includes an electrically conductive channel member which extends about the inner periphery of the oven door defining a recessed channel which when the door is closed is in juxtaposition with the planar conductive surface which defines the access opening to the cavity. Microwave pervious electrical insulation is interposed in the door gap between the channel member and the planar surface to provide a first microwave energy transmission path for energy attempting to escape through the door gap. A transmission member is disposed within the recessed channel and extending along the length thereof to provide a second transmission path between the channel walls and the transmission member for energy attempting to escape through the door gap. The second path originates at an inner intersection with the first path relatively near the inner edge of the door gap and terminates at a second or outer intersection with the first path relatively near the outer edge of the door gap. The first and second paths are configured in the vicinity of the inner intersection of the two paths to split therebetween the energy attempting to escape through the door gap, and to combine the energy propagating along the second path with energy propagating along the first path at the outer intersection of the two paths. The electrical length of the second path between the two intersections differs from the electrical length between these two intersections along the first path by an odd integral multiple of one-half the wavelength of the energy. Hence, upon recombination energy from one path differs in phase relative to energy from the other by approximately a half wavelength and the energy from one path substantially cancels energy from the other, inhibiting energy leakage beyond the door gap.

In accordance with another aspect of the invention, the transmission member comprises a periodic structure which supports a TEM propagating mode along the first and second transmission paths.

In accordance with yet another aspect of the invention, the channel is partitioned into parallel chambers, one containing the transmission member and the other defining a quarter wave choke structure.

In accordance with yet another aspect of the invention, the transmission member is positioned in the channel to define a quarter wave choke region, which region forms a portion of the second transmission path.

BRIEF DESCRIPTION OF THE DRAWINGS

While the novel features of the invention are set forth with particularity in the appended claims, the invention will be better understood and appreciated from the following detailed description taken in conjunction with the drawings in which:

FIG. 1 is a perspective view of a microwave oven embodying one form of the present invention;

FIG. 2 is an enlarged cross-sectional view of a portion of the interface between the cooking cavity wall and the oven door of the oven of FIG. 1, with the door closed, illustrating a first embodiment of the door seal arrangement of the present invention;

FIG. 2A is a simplified schematic structural view of the cavity and door interface of FIG. 2 figuratively illustrating the energy transmission paths through the door gap;

FIG. 3 is an enlarged perspective view of a portion of the door of FIG. 2;

FIG. 4 is an enlarged perspective view of an alternative embodiment of the transmission member for the door seal structure embodiment of FIGS. 2 and 3;

DESCRIPTION OF THE INVENTION

Figure 5:
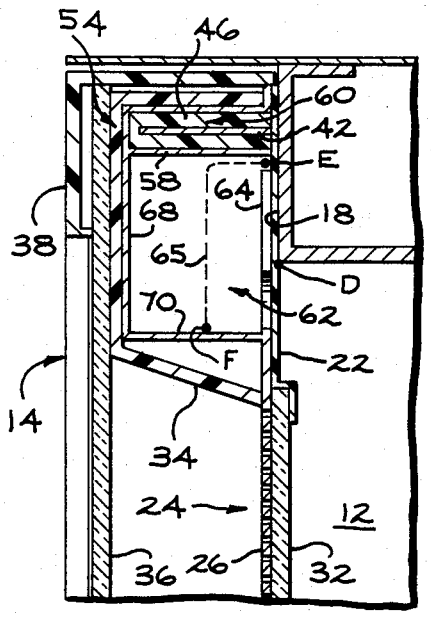
FIG. 5 is an enlarged cross-sectional view of a portion of the interface between the cooking cavity wall and the oven door of the oven of FIG. 1, with the door closed, illustrating a second embodiment of the door seal arrangement of the present invention.

The following description includes several illustrative embodiments of the invention in which many of the structural elements are very similar or identical. For clarity and ease of understanding, such corresponding structural elements will be identified by the same reference numeral in each embodiment in which they appear.

Referring now to FIG. 1, the energy seal of the present invention is adapted for use in a microwave oven 10 having a cooking cavity 12 provided with a front facing access opening. The access opening is covered by a hinged door 14. Cooking cavity 12 is defined by orthogonally oriented top, bottom, rear and side conductive walls 16. The access opening is circumscribed by a door frame including a generally planar conductive surface 18 configured like a rectangular picture frame.

Microwave energy is supplied to the oven cavity 12 by means of a magnetron (not shown) located in a control compartment generally situated behind control panel 20. Typically, the magnetron is selected to produce microwave energy having a nominal frequency of 2450 MHz. The energy may be coupled from the magnetron to the cooking cavity by any one of numerous arrangements well known in the art. It is understood that numerous other components are required in a complete microwave oven, but are not shown or described herein since they can be conventional in nature and, as such, are well known to those skilled in the art.

In accordance with the present invention a door seal arrangement is provided in the door for inhibiting microwave energy leakage through the door gap defined between door 14 when closed and planar surface 18 which circumscribes the cavity access opening.

The door seal arrangement, as will be described in detail in the description of several illustrative embodiments to follow, includes first transmission path for microwave energy escaping from the cavity through the door gap from the cooking cavity and a second transmission path which intersects the first path at an inner intersection near the inner edge of the door gap relatively close to the cavity and at an outer intersection near the outer edge of the door gap relatively remote from the cavity. The first and second paths are configured in the vicinity of the inner intersection to split therebetween the energy attempting to escape from the cavity through the door gap and to recombine at the outer intersection, the energy propagating along the second path with energy continuing along the first path. The electrical length of the second path between the two intersections differs from the electrical length between these two points measured along the first path by an odd integral multiple of one-half the wavelength of the energy, preferably one half wavelength, so that at the second intersection the energy from one path differs in phase relative to energy from the other path by approximately one-half wavelength. Due to this difference in phase, when recombined at the outer intersection the energy from one path tends to substantially cancel energy from the other with the ultimate result that energy leakage beyond the second intersection is inhibited. A significant advantage of the door seal arrangement of this invention is that this arrangement is less sensitive to door gap variations than prior art choke type door seal structures.

FIGS. 2, 2A and 3 show a first illustrative embodiment of a door seal arrangement in accordance with the present invention. FIG. 2 shows the door in its closed position in which the inner panel 22 of door 14 is against planar surface 18. FIG. 3 illustrates the door seal structure carried on the door.

Door 14 comprises a main rectangular sheet metal body member 24 having a lateral extent generally commensurate with door 14 of FIG. 1, only a portion of which is shown in FIGS. 2 and 3. Body member 24 includes a central perforated screen portion 26 and a peripheral channel member 28 of U-shaped cross-section. Channel 28 forms the sides of a rectangular picture frame shape which frames screen portion 26. The openings 30 in screen 26 are conventionally selected to be sufficiently small to prevent transmission of microwave energy therethrough but sufficiently large to permit viewing of the oven cavity 12 through the door. An inner viewing panel 32 of glass or plastic to prevent dirt and food products residue from coming into contact with the screen is held in place on the inner face of screen portion 26 by inner door panel 22. Inner door panel 22 covers that portion of the inner face of body member 24 between screen portion 26 and the outer periphery of door 14 and is secured to body member 24 by any suitable means such as staking. Panel 22 is formed of a microwave pervious, electrically insulating material, such as polypropylene.

Door 14 further includes a plastic appearance baffle 34 which extends about the periphery of the outer face of screen portion 26 and is suitably secured to body member 24 to provide an attractive frame for screen 26. An outer panel 36 of glass or plastic serves as the outer covering for door 14, providing an attractive appearance while permitting viewing of the cooking cavity. Panel 36 is held in place by outer trim frame 38.

Channel member 28 defines a recessed channel 40 extending about the periphery of the door in juxtaposition with planar surface 18 when door 14 is closed. With door 14 in its closed position, panel 22 extends between channel member 28 and planar surface 18 to prevent electrical contact therebetween, and to maintain a door gap about the perimeter of the access opening between planar surface 18 and channel member 28, which gap provides a well defined transmission path therebetween for microwave energy attempting to escape from cavity 12.

A transmission member 42 is positioned in channel 40 to establish a second transmission path. Transmission member 42 is a generally planar conductive member which is generally centrally positioned in channel 40 and extends along the length thereof. Member 42 can be one piece extending all the way around the door or a number of pieces electrically joined to form a continuously conductive member. Transmission member 42 is electrically insulated from channel member 28 by insulation 46 which is a microwave pervious plastic material such as polypropylene. As best seen in FIG. 3, resonant slots 44 are spaced apart along the length of member 42 centered at quarter wavelength intervals to define a periodic structure which inhibits longitudinal current in the channel, thereby supporting only the TEM propagating mode in the channel and in the door gap in the region proximate the channel.

FIG. 2A is a simplified schematic representation of the channel member 28, transmission member 42 and planar surface 18 of FIG. 2, with insulation not shown, to figuratively illustrate the transmission paths for the embodiment of FIG. 2. The first transmission path between surface 18 and channel member 28 follows dotted line 48. The second transmission path follows dotted line 50 originating at inner intersection A, near the inner edge of the door gap relatively near cavity 12, and terminating at outer intersection B near the outer edge of the door gap relatively remote from cavity 12.

The width of transmission member 42 is selected to provide an electrical length between inner intersection A and outer intersection B along path 50 which for the TEM mode at the magnetron operating frequency is one-half wavelength longer than the electrical distance between these intersections along path 48. It is of course to be understood that longer paths could be similarly employed provided the effective electrical length is an odd integral multiple of the half wavelength.

Edge 52 of member 42 defines a capacitive voltage divider gap between member 42 and planar surface 18. The width of this gap is empirically adjusted to achieve the desired split of energy at intersection A. In this embodiment the gap is adjusted to provide a power split between paths 48 and 50, such that upon combination at B the magnitudes of the energy from each path propagating toward the exterior of the oven are approximately equal but out of phase by one-half wavelength, resulting in substantial cancellation of energy from one path by energy from the other path.

Variations in the door gap dimensions will vary the energy split at A. However, at B energy from path 50 divides, with a portion seeking to propagate outwardly through the door gap to the exterior and a portion propagating inwardly back along path 48 toward the cavity. An increase in door gap causes a lesser percentage of energy to enter path 50 at A, but causes a greater percentage of the energy arriving at B along path 50 to propagate outwardly. This latter increase compensates at least in part for the change in the split at A. Hence, this door seal arrangement is less sensitive to variations in door gap width than conventional choke seal arrangements.

In the illustrative embodiments described herein the transmission member disposed in the channel is a periodic structure formed by an appropriately slotted planar conductive member. Use of a periodic structure in this fashion is advantageous in that the periodic structure serves to suppress longitudinal currents in the transmission member, thereby permitting only TEM mode propagation along leakage transmission paths. The wavelength for TEM mode propagation is the free space wavelength at the magnetron operating frequency adjusted by the dielectric contstant for the dielectric medium. Alternatively, the transmission member could be fabricated as a printed circuit member 42' as shown in FIG. 4. In this embodiment, a plurality of conductive segments 43 are printed on substrate 45 with gaps 47 therebetween spaced at quarter wavelength intervals. A second substrate 49 overlying segments 43 provides the needed electrical isolation of the conductive elements from channel member 28. Segments 43 are positioned on substrate 45 flush with edge 51 of substrate 45 which when positioned in channel 40 faces planar surface 18. The segments are spaced inwardly from the opposite edge 53 of substrate 45 to provide sufficient clearance between segments 43 and channel member 28 when the member is positioned in the channel.

While the periodic structures shown are advantageous as hereinbefore described, it is to be understood that the transmission member could simply comprise a generally planar conductive member identical to member 42 but without slots, in which case energy cancellation would be limited primarily to the dominant TE propagating mode supported in the door gap. Substantial cancellation of the dominant mode may be sufficient, particularly when the phase shifting device is employed in combination with additional sealing structures. However, it is also to be understood that if a periodic structure is not used, the wavelength for design purposes should be the wavelength of the dominant mode.

Figure 6:
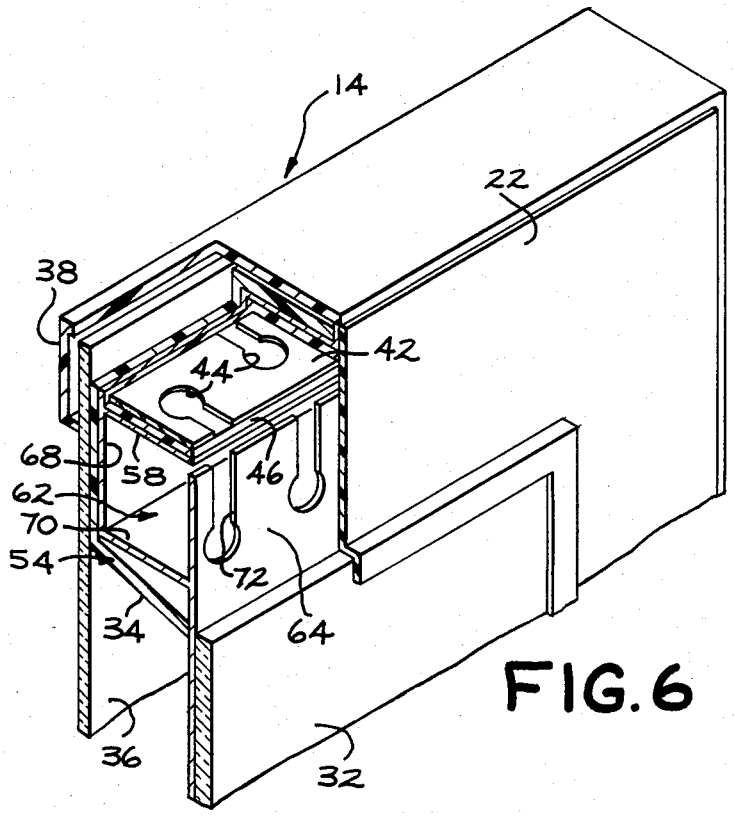
FIG. 6 is an enlarged perspective view of a portion of the door of FIG. 5.

In the embodiment of FIGS. 5 and 6 the door sealing arrangement of FIGS. 2 and 3 is combined with a conventional quarter wave choke, for enhanced leakage attenuation. In this door seal arrangement, energy escaping through the door gap first encounters a quarter wave choke. Energy which propagates beyond the choke is further attenuated by the energy splitting phase shifting channel structure. In the embodiment of FIGS. 5 and 6, channel member portion 54 of body member 24 defines a relatively large recessed channel of U-shaped cross-section which is partitioned by member 58 into two parallel channels of U-shaped crosssection, a phase shift channel 60 and a choke channel 62, each extending about the periphery of the door 14 in juxtaposition with planar surface 18.

Wall portion 64 comprising an extension of the planar central portion of body member 24 overlies a portion of choke channel 62 to complete the quarter wave choke structure. Wall 64, planar surface 18 and cover panel 22 jointly serve to provide a transmission path defined generally between points D and E. A choke transmission path is defined between points E and F along dotted line 65; this path being defined by the side walls 58, 68, 70, and 64 forming choke channel 62, with wall 70 forming (coincident with point F) a terminating conductive surface wall for the choke.

The electrical length from point D to point E is approximately one-quarter wavelength for the TEM mode at the nominal 2450 MHz operating frequency of the magnetron. Similarly, an electrical length of one-quarter wavelength is provided between point E and the wall surface at point F. The electrical length of the total choke path thereby provided is approximately equal to one-half wavelength from point D to point F. In operation, the choke structure is analogous to conventional parallel plate radio frequency transmission line circuits providing a path of maximum resistance for the escaping microwave energy. The gap about the access opening provides a path (D to E) of substantially one-quarter wavelength. At D, a substantial portion of the energy from cavity 12 is transferred along the path E to F of one quarter wavelength terminating in the conductive surface at F. As a result of these parameters an electrical short circuit or low impedance at point F is reflected as a short circuit at point D, preventing a substantial portion of the energy entering the door gap region from leaking to the exterior of the oven. Resonant slots 72 spaced at quarter wave intervals along the length of wall 64 inhibits propagation of microwave energy longitudinally in the choke itself. The choke portion of the device is described briefly here for the sake of completeness. Such slotted choke arrangements are described in greater detail in commonly-assigned U.S. Pat. No. 4,313,044 which is hereby incorporated by reference.

While the slotted choke device by itself is an effective sealing arrangement, its performance is sensitive to variations in door gap spacing. In this embodiment, a voltage dividing and phase shifting device in accordance with the present invention is combined with the slotted choke to further attenuate energy leakage which may escape the choke structure. The structure and manner of operation of phase shift channel 60 and transmission member 42 are identical to that hereinbefore described with reference to FIGS. 2, 2A and 3.

Test results with the embodiment of FIGS. 5 and 6 show that leakage attenuation is increased on the order of 7 dB compared to prior art devices using a conventional slotted choke arrangement for comparable door gap tolerances. Leakage of approximately 0.2 milliwatts was measured with a door gap of $\frac{1}{4}$ inch. With representative prior art devices, the door gap must be limited to 0.06 inch or less to keep leakage within 0.2 milliwatts leakage limit. For normal door gaps on the order of 0.04–0.06 inches, leakage using the seal arrangement illustratively embodied in FIGS. 5 and 6 has been found to be 0.05 milliwatts or less.

Figure 7A:
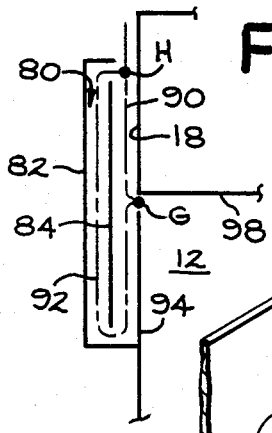
FIG. 7A is a simplified schematic structural view of the cavity and door interface for the embodiment of FIG. 7 figuratively illustrating the energy transmission paths through the door gap provided by the door seal structure of that embodiment.
Figure 7:
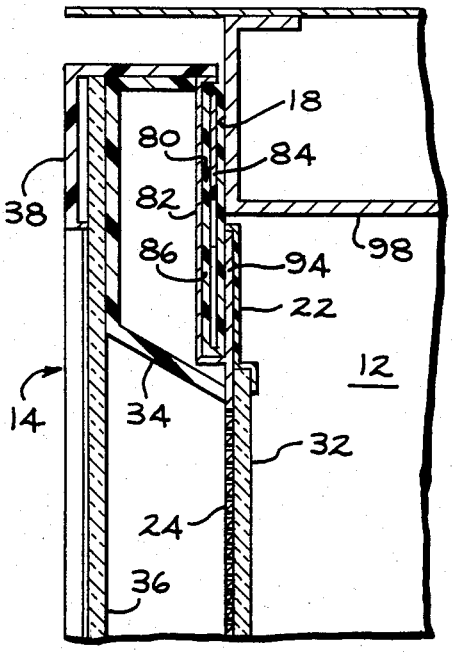
FIG. 7 is an enlarged cross-sectional view of a portion of the interface between the cooking cavity wall and the oven door of the oven of FIG. 1, with the door closed, illustrating a third embodiment of the door seal arrangement of the present invention.

A third embodiment of the seal arrangement of the present invention is shown in FIG. 7. In this embodiment the recessed channel 80 formed by channel member 82 of door body member 24 positions transmission member 84 generally parallel to the plane of the door 14 rather than perpendicular as in embodiments hereinbefore described. Transmission member 84 is enveloped by microwave pervious plastic dielectric material 86 such as polypropylene to electrically insulate member 84 from channel member 82. A portion of the dielectric envelope 86 also serves to electrically isolate transmission member 84 and channel member 82 from planar surface 18 at the interface of surface 18 and door 14.

In this embodiment, as best seen in the simplified schematic form in FIG. 7A, the first transmission path 90 between points G and H for energy propagation through the door gap is defined between transmission member 84 and planar surface 18 through the dielectric insulation 86 (not shown in FIG. 7A). A second path 92 between points G and H is provided between side wall portions of channel member 82 and transmission member 84. Transmission member 84 cooperates with channel wall 94 of channel member 82, cavity top wall portion 98 and planar surface 18 to form a balanced T intersection whereby energy arriving at point G from cavity 12 is generally evenly divided between path 90 and path 92. The width of transmission member 84 is selected to provide an electrical length between points G and H along path 92 which is one half wavelength longer than that between points G and H along path 90. Hence, energy from each path is combined at point H with the energy from one path being of approximately equal amplitude but shifted in phase by one-half wavelength relative to energy from the other path, resulting in energy from one path cancelling energy from the other to provide the desired good leakage attenuation.

Figure 8:
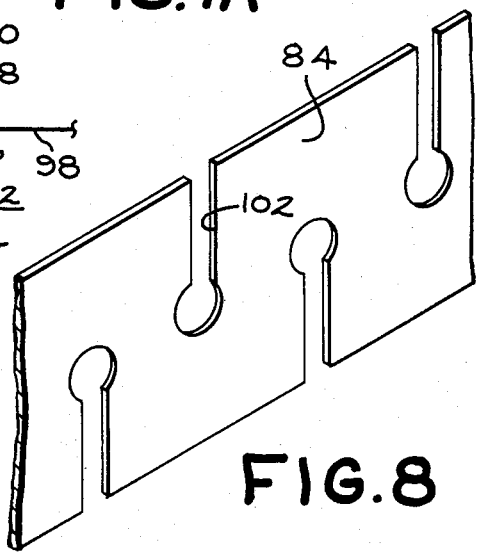
FIG. 8 is an enlarged perspective view of a portion of the transmission member incorporated in the door seal structure of FIG. 7.

FIG. 8 provides a perspective view of transmission member 84 of FIG. 7 showing resonant slots 102 spaced along its length centered at quarter wavelength intervals to provide a periodic structure which inhibits longitudinal currents and supports TEM mode propagation along paths 90 and 92.

Figure 9:
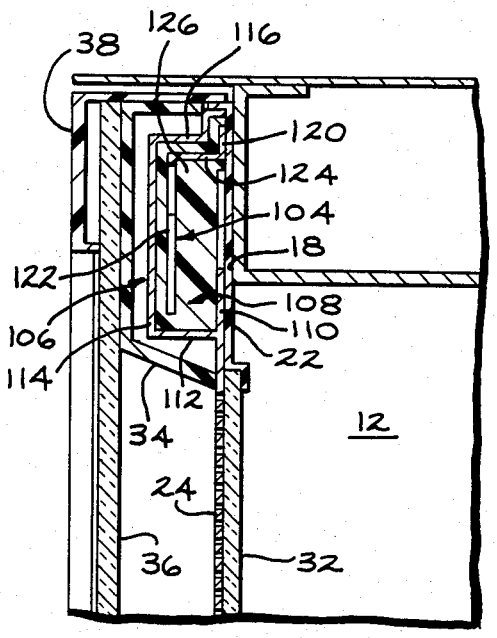
FIG. 9 is an enlarged cross-sectional view of a portion of the interface between the cooking cavity wall and the oven door of the oven of FIG. 1, with the door closed, illustrating a fourth embodiment of the door seal arrangement of the present invention.

A final embodiment which provides another combination of the slotted choke and phase shifting devices is illustrated in FIG. 9. In this embodiment, transmission member 104 is positioned in recessed channel 106 to establish a second transmission path which includes a choke region along its path.

Recessed channel 106 formed by channel member 108 of body member 24 is generally defined by wall members 110, 112, 114 and 116.

Figure 10:
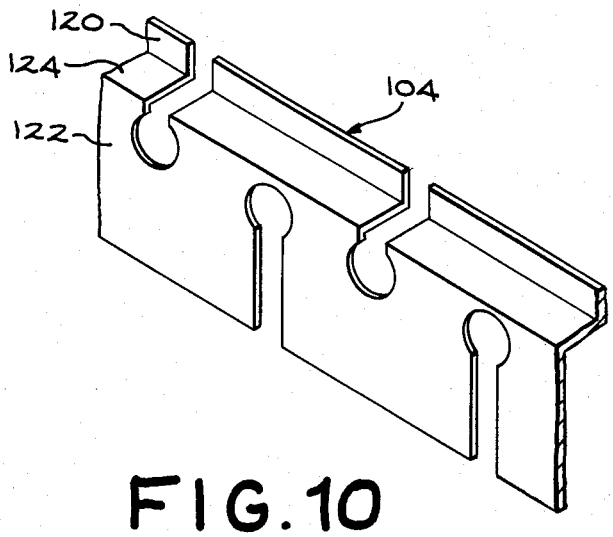
FIG. 10 is an enlarged perspective view of a portion of the transmission member incorporated in the door seal structure of FIG. 9.

As best seen in FIG. 10, transmission member 104 is folded into three portions, a first flange portion 120, and a second flange portion 122, joined by an intermediate step portion 124. Transmission member 104 is positioned in channel 106 to provide a choke region 108 between channel walls 110 and 112, step portion 122 and flange portion 124 of transmission member 104. Channel 106 is filled with a microwave pervious plastic dielectric medium 126 to electrically isolate member 104 from channel member 108 and provide a continuous propagation medium for energy propagating through channel 106.

Figure 9A:
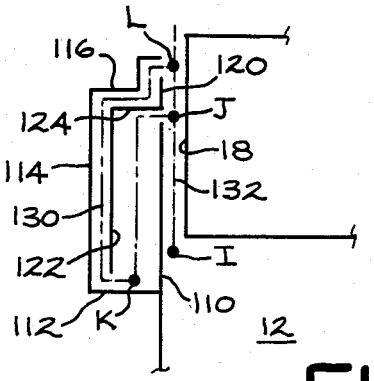
FIG. 9A is a simplified schematic structural view of the cavity and door interface for the embodiment of FIG. 9 figuratively illustrating the energy transmission paths through the door gap provided by the door seal structure of that embodiment.

As best seen in schematic form in FIG. 9A, the choke region forms the initial portion of the second transmission path through the door gap, which begins at point J and follows dotted line 130 to point L. The first transmission path is defined generally between cavity planar surface 18 and channel wall 110, and flange 120 of transmission member 118, following dotted line 132 between points I and L.

Due to the attenuating effects of the choke, only a reduced portion of the energy which entered path 130 at point J reaches point L. Similarly, due to the effects of the choke, only a reduced portion of the energy which enters path 132 at point I continues along path 132 from J to L. The electrical length of path 130 between points J and L is designed to be one half wavelength longer than the electrical length between these points along path 132. As in the other embodiments, this difference in path length causes the energy from one path to be shifted in phase by one half wavelength relative to the energy from the other path. The width of flange portion 120, the thickness of the gap between flange 120 and planar surface 18 and the width of the gap between channel wall member 110 and step portion 122 of transmission member 118, all combine to effect the energy split at point J. Proper empirical selection of the energy split and path length parameters will result in a power split such that the amplitude of the energy arriving at point L via path 130 and propagating outwardly from point L substantially cancels that arriving at point L via path 132. This cancellation of the energy from one path by energy from the other path, effectively inhibits energy leakage beyond point L.

From the foregoing, it is apparent that the present invention provides a door seal arrangement for microwave ovens which inhibits microwave energy leakage through the door gap to levels well within regulatory limits without need for tight control of door gap dimensions. While several embodiments of the invention have been illustrated and described herein, it is realized that numerous modifications and changes will occur to those skilled in the art. For example, the embodiments illustrated herein show the channel portion of the seal structure formed as a part of the door structure cooperating with the planar surface surrounding the enclosure access opening. However, the structure could be reversed with the channel portion of the seal structure formed as part of the enclosure structure and the planar surface being on the door without detracting from the performance of the seal structure. It is therefore intended to cover all such modifications and changes as fall within the true spirit and scope of the invention.

What is claimed is:

1. In a microwave oven comprising a source of microwave energy having a predetermined frequency and wavelength, an enclosure having located therein a cooking cavity for receiving items to be heated by the microwave energy, the cooking cavity having an access opening, a door for opening and closing the access opening, the door and enclosure defining therebetween a door gap, a door seal arrangement for inhibiting the leakage of microwave energy through the door gap, said door seal arrangement comprising:

one of the door and the enclosure defining an electrically conductive planar surface generally parallel to the plane of the door in its closed position;

the other of the door and enclosure having an electrically conductive channel member defining a recessed channel, said planar surface and said channel member each extending in juxtaposition with each other with the door in its closed position about the periphery of the access opening;

microwave pervious electrical insulation means interposed between said channel member and said planar surface, said insulation means and said channel member cooperating with said planar surface to define a first transmission path for microwave energy propagating through the door gap;

a transmission member disposed within said recessed channel and extending along the length thereof, said transmission member and said channel member establishing a second transmission path for microwave energy propagating through the door gap, said second path intersecting said first path at an inner intersection relatively near the cavity and at an outer intersection relatively remote from the cavity;

said first and second paths being configured proximate said inner intersection to split therebetween energy propagating through the door gap from the cavity and to recombine energy propagating along said second path with energy propagating along said first path proximate said outer intersection, the effective electrical length between said inner and outer intersections measured along said second path differing from the distance between said intersections measured along said first path such that proximate said outer intersection, energy from one of said paths differs in phase relative to that from the other path by approximately a half wavelength whereby upon recombination, energy from one of said paths substantially cancels energy from the other one of said paths, effectively inhibiting energy leakage beyond the door gap.

2. The door seal arrangement of claim 1 wherein said transmission member comprises a periodic structure adapted to support a TEM propagating mode for energy propagating along said first and second paths.

3. The door seal arrangement of claim 1 wherein said transmission member is a generally planar electrically conductive member electrically insulated from said channel member and has formed therein a plurality of resonant slots spaced apart along the length of said transmission member at quarter wavelength intervals to support the TEM propagating mode.

4. The door seal arrangement of claim 1 wherein said transmission member comprises a generally planar electrically conductive member, electrically insulated from said channel member.

5. The door seal arrangement of claim 1 wherein said transmission member comprises a plurality of generally planar, conductive segments equidistantly spaced apart along the length of said channel and electrically insulated from said channel member and from each other, the gaps between conductive segments being spaced at quarter wavelength intervals whereby said transmission member cooperates with said channel member to support a TEM propagation mode for energy propagating along said first and second paths.

6. The energy seal arrangement of claim 1 wherein said channel member includes a partition member which divides said recessed channel into two substantially parallel chambers extending along the length of said channel member, said transmission member being disposed in one of said chambers to establish said second path, the other of said chambers forming a quarter-wave choke about the periphery of said access opening.

7. The energy seal arrangement of claim 6 wherein said channel member further comprises a wall portion adjacent the planar surface and extending parallel thereto defining therebetween a portion of said first path, said wall portion having resonant slots spaced at quarter wavelength intervals formed along the length thereof to support a TEM propagating mode along said first path, and wherein said transmission member comprises a generally planar conductive member having resonant slots spaced at quarter wavelength intervals along the length thereof to support a TEM propagating mode for energy propagating along said second path.

8. The door seal arrangement of claim 1 wherein said transmission member comprises a generally planar member folded and positioned in said channel to establish in combination with said channel member a quarter wave choke region which defines a portion of said second path between said intersections.

9. The door seal arrangement of claim 8 wherein said channel member comprises a wall portion adjacent the planar surface when the door is closed defining therebetween a portion of said first path and having resonant slots spaced at quarter wavelength intervals along the length thereof to support a TEM propagating mode along said first path, and wherein said transmission member has resonant slots spaced at quarter wavelength intervals along the length thereof to support a TEM propagation mode for energy propagating along said second path.

10. In a microwave oven comprising a source of microwave energy having a predetermined frequency and corresponding wavelength, an enclosure having located therein a cooking cavity for receiving items to be heated by the microwave energy, the enclosure including a planar conductive surface defining an access opening to the cavity and a door for opening and closing the access opening, the planar surface and door when closed defining therebetween a door gap, a door seal arrangement for inhibiting the leakage of microwave energy through the door gap, said door seal arrangement comprising:

an electrically conductive channel member extending along the inner periphery of the door, defining a recessed channel in juxtaposition with the planar conductive surface when the door is closed;

microwave pervious electrical insulation means interposed between said channel member and the planar surface, said insulation means and said channel member cooperating with the planar surface to define a first transmission path for microwave energy propagating through the door gap;

a transmission member disposed within said recessed channel and extending along the length thereof, said transmission member and said channel member establishing a second transmission path for microwave energy propagating through the door gap, said second path intersecting said first path at an inner intersection relatively near the cavity and at an outer intersection relatively remote from the cavity;

said first and second paths being configured proximate said inner intersection to split therebetween energy propagating through the door gap from the cavity and to recombine energy propagating along said second path with energy propagating along said first path proximate said outer intersection, the effective electrical length between said inner and outer intersections measured along said second path differing from the distance between said intersections measured along said first path such that proximate said outer intersection, energy from one of said paths differs in phase relative to that from the other path by approximately a half wavelength whereby upon recombination, energy from one of said paths substantially cancels energy from the other one of said paths, effectively inhibiting energy leakage beyond the door gap.

11. The door seal arrangement of claim 10 wherein said transmission member comprises a periodic structure adapted to support a TEM propagating mode for energy propagating along said first and second paths.

12. The door seal arrangement of claim 10 wherein said transmission member is a generally planar electrically conductive member electrically insulated from said channel member and has formed therein a plurality of resonant slots spaced apart along the length of said transmission member at quarter wavelength intervals to support the TEM propagating mode.

13. The door seal arrangement of claim 10 wherein said transmission member comprises a generally planar electrically conductive member, electrically insulated from said channel member.

14. The door seal arrangement of claim 10 wherein said transmission member comprises a plurality of generally planar, conductive segments equidistantly spaced apart along the length of said channel and electrically insulated from said channel member and from each other, the gaps between conductive segments being spaced at quarter wavelength intervals whereby said transmission member cooperates with said channel member to support a TEM propagating mode for energy propagating along said first and second paths.

15. The door seal arrangement of claim 10 wherein said channel member includes a partition member which divides said recessed channel into two substantially parallel chambers extending along the length of said channel member, said transmission member being disposed in one of said chambers to establish said second path, the other of said chambers forming a quarter-wave choke about the periphery of said access opening.

16. The door seal arrangement of claim 15 wherein said channel member further comprises a wall portion adjacent the planar surface and extending parallel thereto defining therebetween a portion of said first path, said wall portion having resonant slots spaced at quarter wavelength intervals formed along the length thereof to support a TEM propagating mode along said first path, and wherein said transmission member comprises a generally planar conductive member having resonant slots spaced at quarter wavelength intervals formed along the length thereof to support a TEM propagation mode for energy propagating along said second path.

17. The door seal arrangement of claim 10 wherein said transmission member comprises a generally planar member folded and positioned in said channel to establish in combination with said channel member a quarter wave choke region which defines a portion of said second path between said intersections.

18. The door seal arrangement of claim 17 wherein said channel member comprises a wall portion adjacent the planar surface when the door is closed defining therebetween a portion of said first path and having resonant slots spaced at quarter wavelength intervals along the length thereof to support a TEM propagating mode along said first path, and wherein said transmission member comprises a generally planar, conductive member having resonant slots spaced at quarter wavelength intervals along the length thereof to support a TEM propagating mode for energy propagating along said second path.

19. In a microwave oven comprising a source of microwave energy and an enclosure having a cooking cavity located therein for receiving the items to be heated by the microwave energy, the enclosure including a first planar conductive surface defining an access opening to the cavity and a door for opening and closing the access opening, the first planar surface and door when closed defining therebetween a microwave pervious door gap, a door seal arrangement for inhibiting the leakage of microwave energy through the door gap, said door seal arrangement comprising:

an electrically conductive channel member extending along the inner periphery of the door, defining a recess channel in juxtaposition with the first planar conductive surface;

a transmission member disposed within said channel extending along the length thereof;

said transmission member being positioned within said recessed channel to define first and second transmission paths for microwave energy entering the door gap region from the cavity, said first and second paths being operative to substantially equally divide energy entering the door gap from the cavity and to recombine the energy propagated along each path, one of said paths differing in effective electrical length relative to the other of said paths by an odd integral multiple of half-wavelengths such that the energy exiting one of said paths is shifted in phase by a half-wavelength relative to energy exiting the other of said paths whereby upon recombination energy exiting one of said paths substantially cancels energy exiting the other of said paths effectively inhibiting energy leakage through the door gap.

20. The door seal arrangement of claim 19 wherein said transmission member comprises a conductive member electrically insulated from said channel member and having resonant slots spaced at quarter wavelength intervals formed along the length thereof to support a TEM propagation mode for energy propagating along said first and second paths.

21. The door seal arrangement of claim 19 wherein said transmission member comprises a plurality of generally planar, conductive segments equidistantly spaced apart along the length of said channel, said segments being electrically insulated from said channel member and from each other, the gaps between adjacent segments being spaced at quarter wavelength intervals whereby said transmission member cooperates with said channel member to support a TEM propagation mode for energy propagating along said first and second paths.

* * * * *